US008384611B2

(12) United States Patent
Asakura et al.

(10) Patent No.: US 8,384,611 B2
(45) Date of Patent: Feb. 26, 2013

(54) ANTENNA DEVICE, ANTENNA REFLECTOR, AND WIRELESS COMMUNICATION UNIT INCORPORATING ANTENNA

(75) Inventors: Kenji Asakura, Fukui (JP); Kiyotada Yokogi, Tokyo (JP)

(73) Assignee: Sony Corporation, Tokyo (JP)

( * ) Notice: Subject to any disclaimer, the term of this patent is extended or adjusted under 35 U.S.C. 154(b) by 839 days.

(21) Appl. No.: 11/652,952

(22) Filed: Jan. 12, 2007

(65) Prior Publication Data

US 2007/0247388 A1 Oct. 25, 2007

(30) Foreign Application Priority Data

Jan. 19, 2006 (JP) ..... 2006-011175

(51) Int. Cl.
*H01Q 19/10* (2006.01)

(52) U.S. Cl. ..... 343/834; 343/832; 343/836

(58) Field of Classification Search ..... None
See application file for complete search history.

(56) References Cited

U.S. PATENT DOCUMENTS

| | | | | |
|---|---|---|---|---|
| 2,270,314 | A * | 1/1942 | Kraus | 343/834 |
| 6,175,338 | B1 * | 1/2001 | Quade | 343/795 |
| 6,195,063 | B1 * | 2/2001 | Gabriel et al. | 343/797 |
| 6,917,346 | B2 * | 7/2005 | Izzat et al. | 343/895 |
| 6,940,470 | B2 * | 9/2005 | Nesic et al. | 343/895 |
| 7,839,347 | B2 * | 11/2010 | Schneider et al. | 343/834 |
| 7,898,492 | B2 * | 3/2011 | Williams | 343/836 |
| 2005/0068245 | A1 * | 3/2005 | Chen | 343/834 |
| 2006/0017643 | A1 * | 1/2006 | Shimasaki et al. | 343/795 |
| 2007/0152881 | A1 * | 7/2007 | Chan | 343/700 MS |
| 2007/0188400 | A1 * | 8/2007 | Fujita | 343/834 |
| 2010/0073251 | A1 * | 3/2010 | Mizushina et al. | 343/818 |
| 2010/0092247 | A1 * | 4/2010 | Hecht et al. | 405/232 |

FOREIGN PATENT DOCUMENTS

| | | |
|---|---|---|
| JP | 06-26433 | 9/1994 |
| JP | 09-153736 | 6/1997 |

* cited by examiner

*Primary Examiner* — Trinh Dinh
(74) *Attorney, Agent, or Firm* — Robert J. Depke; The Chicago Technology Law Group, LLC

(57) ABSTRACT

Disclosed herein is an antenna device including, a radiator having a feeder, and a planar reflector spaced from the radiator in a radio wave incoming direction, the reflector having at least one slit defined in a side edge thereof.

13 Claims, 16 Drawing Sheets

ANTENNA DEVICE, ANTENNA REFLECTOR, AND WIRELESS COMMUNICATION UNIT INCORPORATING ANTENNA

CROSS REFERENCES TO RELATED APPLICATIONS

The present invention contains subject matter related to Japanese Patent Application JP 2006-011175 filed in the Japanese Patent Office on Jan. 19, 2006, the entire contents of which being incorporated herein by reference.

BACKGROUND OF THE INVENTION

1. Field of the Invention

The present invention relates to an antenna device, which has a radiator and a reflector, for combining a radio wave arriving from an incoming direction and a reflected wave from the reflector with each other with the radiator, and receiving the combined wave, an antenna reflector, and a wireless communication unit incorporating an antenna therein, and more particularly to an antenna device using a planar reflector for achieving high directivity, an antenna reflector, and a wireless communication unit incorporating an antenna therein.

More specifically, the present invention is concerned with an antenna device having a high front-to-rear ratio and a small size, an antenna reflector, and a wireless communication unit incorporating an antenna therein, and more particularly to an antenna device having a high front-to-rear ratio though a planar reflector has reduced dimensions, an antenna reflector, and a wireless communication unit incorporating an antenna therein.

2. Description of the Related Art

An array antenna, typified by a Yagi antenna (see, for example, Japanese patent Laid-open No. Hei 11-68452) has an element, called a feed element, connected to a power supply and another passive element not connected to a power supply for better antenna characteristics.

The phase of the current of the passive element varies depending on the distance between the elements and the length of the elements due to the combination with the feed element. For example, if an array antenna includes two elements, i.e., a pair of feed and passive elements, then the passive element may be spaced about a quarter of the used wavelength $\lambda$ from the feed element in a direction opposite to the radio wave incoming direction. The feed element combines the radio wave from the incoming direction and a reflected wave from the passive element in phase with each other for receiving the radio wave with a high antenna gain.

The phase of the current of the passive element depends on the length of the passive element. If the length of the passive element is equal to or greater than one half $\lambda/2$ of the used wavelength $\lambda$, then the phase of the current of the passive element is of about 90 degrees. If the length of the passive element is smaller than one half $\lambda/2$ of the used wavelength $\lambda$, then the phase of the current of the passive element is of about 220 degrees.

If the length of the passive element is equal to or greater than $\lambda/2$, then the electric field is greater in a forward direction from the passive element to the feed element, exhibiting such a directivity that a radiated radio wave looks as if it is reflected by the passive element and radiated toward the feed element, so that the antenna has a high front-to-rear ratio. In this case, the passive element serves as a reflector, and the feed element as a radiator.

If the length of the passive element is smaller than $\lambda/2$, then the electric field directed in the forward direction from the passive element to the feed element is smaller, and the electric field directed in a rearward direction from the feed element to the passive element is greater. In this case, the passive element is considered to guide the radiation of the radio wave, and serves as a waveguide rather than a reflector. The antenna has a low front-to-rear ratio.

For constructing a reception antenna including a radiator and a reflector and having a high front-to-rear ratio, some size limitations are imposed on the reception antenna such that the distance between the radiator and the reflector be of a quarter of the used wavelength $\lambda$ and the dimension of the reflector in the direction of the electric field be of $\lambda/2$ or greater.

Array antennas such as Yagi antennas are capable of developing a maximum electric field in the direction of the array between two antenna elements whose power supply polarities are inversely connected (reverse-phase array). Such an antenna arrangement is called "end-fire array antenna".

Another example of end-fire array antenna is a dipole antenna with a reflector plate (see, for example, Japanese patent Laid-open No. Hei 6-268433). The dipole antenna includes a conductor plate acting as a reflector and a dipole antenna disposed parallel to the surface of the conductor plate. An image antenna is produced behind the conductor plate in reverse phase with the dipole antenna, making the array antenna equivalent to a reverse-phase dipole array antenna. A radio wave radiated from the dipole antenna is radiated forwardly of the conductor plate as if reflected by the conductor plate. The single antenna provides a directivity equivalent to that of a two-element array antenna.

A corner reflector antenna (see, for example, Japanese patent Laid-open No. Hei 9-153736) includes a reflector, i.e., a corner reflector, in the form of a conductor plate bent through a predetermined angle $\psi$ along a ridge in a main direction of polarization, and a dipole antenna extending parallel to the ridge and spaced from its vertex by a quarter of the used wavelength $\lambda$. An image antenna with respect to the dipole antenna is produced behind each of the surfaces of the bent conductor plate. One of the surfaces of the bent conductor plate produces an image conductor plate of the other surface, and the image conductor plate produces an image antenna with respect to the image antenna. Therefore, a total of three image antennas are produced, making the corner reflector antenna equivalent to four array antennas. The dipole antenna and its image antenna are in reverse phase with each other, and the image antenna and its image antenna are in reverse phase with each other. Consequently, the corner reflector antenna is equivalent to two sets of reverse-phase array antennas. The combined directivity of the four array antennas is determined according to the principles of the product of directivities. No radio wave is reflected rearwardly of the conductor plate, and the directivity is confined only in a small range sandwiched by the bent second plane, resulting in a unidirectional antenna with sharp directivity.

Recently, the wireless data communication technologies are finding their use in a rapidly spreading application range. For example, the Bluetooth communications, which are known as standards for providing wireless connection interfaces applicable to various industries, provide a wireless communication technology for connecting mobile terminals. For example, wireless links based on the Bluetooth communications may be applied to connect a main telephone set and a cordless handset, a portable music player and a headset, or a stereo component and a speaker.

Applications of the Bluetooth communications include data communications from a wireless microphone as an acoustic data source to a receiver unit as a sink for receiving and transferring acoustic data to a recorder, e.g., a video recorder. The wireless microphone allows the video subject to move in a range that is not limited by the microphone cord.

The reception antenna of the receiver unit is required to have sharp directivity toward the wireless microphone. Therefore, an antenna device having a planar reflector, such as a corner reflector antenna having a high front-to-rear ratio, is considered to be desirable for use as the reception antenna of the receiver unit.

If a receiver unit incorporates an antenna device therein, then the antenna device needs to be small in size. Since a radiator is disposed in front of a reflector, it is desirable to provide a space for accommodating other circuit components behind the reflector. The antenna device is required to have a high front-to-rear ratio in order to avoid the generation of an interference wave against the circuit components.

However, the antenna device is subject to such limitations that the distance between the radiator and the reflector be of about a quarter of the used wavelength $\lambda$ and the dimension of the reflector in the direction of the electric field (polarizing direction) be of $\lambda/2$ or more, as described above. For example, it is assumed that the antenna device employs a rectangular planar reflector and has an operation frequency band of 2.45 GHz. If the dimension of the reflector in the direction of the polarizing direction is smaller than $0.4\lambda$, then the reflector does not operate, and the antenna device has a poor front-to-rear ratio. The dimensional lower limit is $0.4\lambda$ for a sheet-metal reflector, and $0.4\lambda/\sqrt{\in_{eff}}$ for a reflector with a dielectric substance having a dielectric constant $\in_{eff}$. If the front-to-rear ratio is poor, then operation of the circuit module disposed behind the reflector tends to be adversely affected.

SUMMARY OF THE INVENTION

It is desirable for the present invention to provide an antenna device which employs a planar reflector for high directivity, an antenna reflector, and a wireless communication unit incorporating an antenna therein.

The present invention is also desirable to provide an antenna device which has a high front-to-rear ratio and small in size, an antenna reflector, and a wireless communication unit incorporating an antenna therein.

The present invention is also desirable to provide an antenna device which employs a planar reflector with reduced dimensions and has a high front-to-rear ratio, an antenna reflector, and a wireless communication unit incorporating an antenna therein.

According to the present invention, there is provided an antenna device including a radiator having a feeder and a planar reflector spaced from the radiator in a radio wave incoming direction, the reflector having at least one slit defined in a side edge thereof.

An end-fire array antenna including a radiator and a reflector generally has such a size that the distance between the radiator and the reflector is represented by about $\lambda/4$ and the reflector has a dimension of $\lambda/2$ or greater in the direction of an electric field. With the antenna device according to the present invention, the slit defined in the side edge of the reflector which is parallel to a main plane of polarization of the radiator makes it possible to increase the equivalent line length. As a result, even if the dimension of the reflector in the direction of the electric field is reduced to one half of the used wavelength $\lambda$, the antenna device can have a front-to-rear ratio equal to the front-to-rear ratio of an antenna device having a corresponding dimension of $\lambda/2$ or more.

In view of the fact that the current distribution of the reflector is high substantially centrally at the side edge in the direction of the electric field, it is efficient for the slit to be positioned substantially centrally at the side edge in the direction of polarization.

The reflector includes a quadrangular conductor plate, for example, and has slits defined in respective lateral sides thereof which are parallel to the direction of polarization. For uniformizing the directivity of the antenna device laterally, the slits defined in the respective sides should preferably be symmetrical with respect to the direction of polarization.

The slits may be linear or curved in shape, or may be of a more complex fractal pattern.

The radiator may be a linearly polarized antenna such as a dipole antenna, for example. In this case, the reflector should preferably have slits defined in respective lateral sides thereof parallel to a main direction of polarization of the radiator symmetrically with respect to the main plane of polarization.

Alternatively, the radiator may be a circularly polarized antenna such as an Archimedean spiral antenna. In this case, the reflector should preferably have a pair of slits or two pairs of slits arranged in point symmetry with respect to the direction of radiation of the radiator. For example, if the reflector has two pairs of side edges (sides) arranged in point symmetry with respect to the direction of radiation, then slits arranged in point symmetry may be defined in the side edges. With such an arrangement, a small-size circularly polarized antenna having a good front-to-rear ratio is provided.

The reflector may be a corner reflector in the form of a conductor plate bent through a predetermined angle $\psi$ along a given ridge. In this case, the radiator is spaced from the vertex of the ridge by a quarter of the used wavelength $\lambda$. The radiator includes a linearly polarized antenna, and the ridge of the conductor plate is disposed so as to be present on the main plane of polarization of the radiator. The radiator may be a stack antenna including a stack of conductor patterns disposed on a flexible printed board.

According to the present invention, there is provided an antenna device which employs a planar reflector for high directivity, an antenna reflector, and a wireless communication unit incorporating an antenna therein.

According to the present invention, there is also provided an antenna device which has a high front-to-rear ratio and small in size, an antenna reflector, and a wireless communication unit incorporating an antenna therein.

According to the present invention, there is further provided an antenna device which employs a planar reflector with reduced dimensions and has a high front-to-rear ratio, an antenna reflector, and a wireless communication unit incorporating an antenna therein.

According to the present invention, it is possible to reduce the size of the reflector and hence to reduce the overall size of the antenna device. The antenna device exhibits a better front-to-rear ratio than an antenna device having a reflector of the same size.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1A:
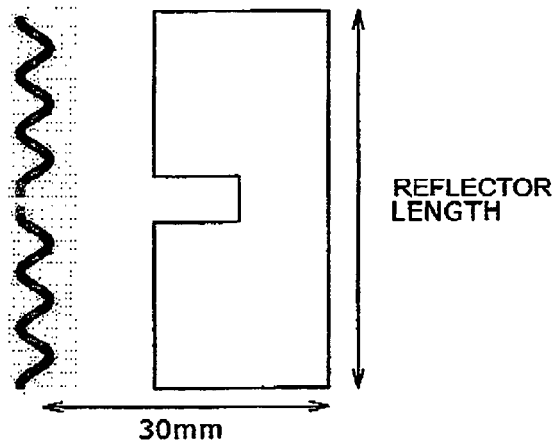
FIG. 1A is a side elevational view of an antenna device according to an embodiment of the present invention.
Figure 1B:
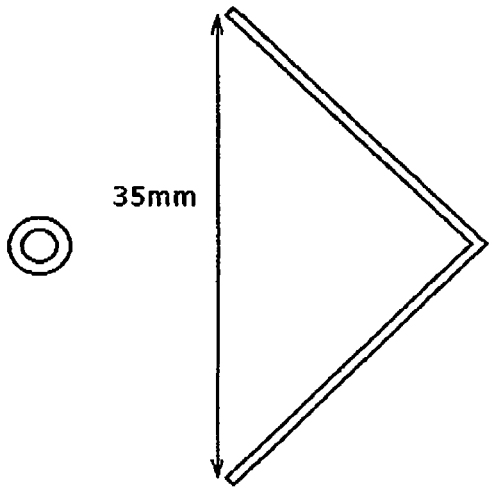
FIG. 1B is a plan view of the antenna device according to the embodiment of the present invention.
Figure 1C:
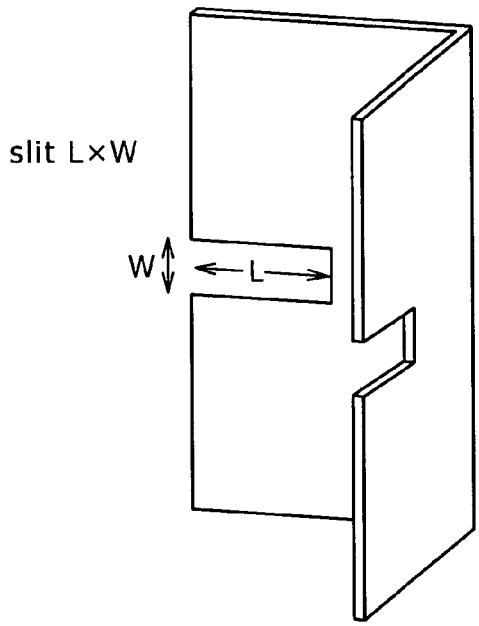
FIG. 1C is a perspective view of the antenna device according to the embodiment of the present invention.
Figure 2:
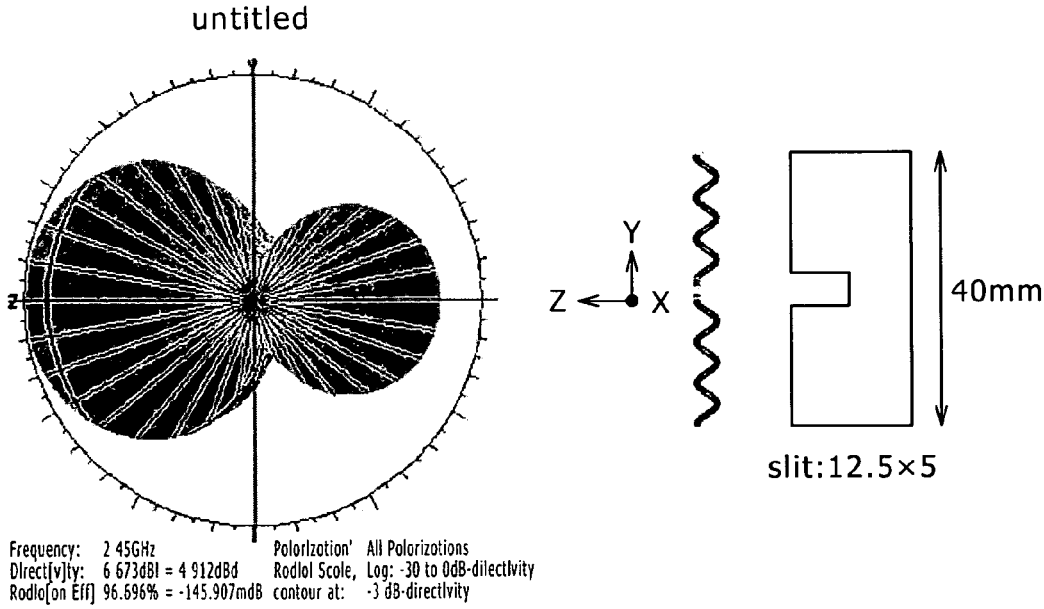
FIG. 2 is a graph showing directivity characteristics of an antenna device #1 listed in Table 1.
Figure 3:
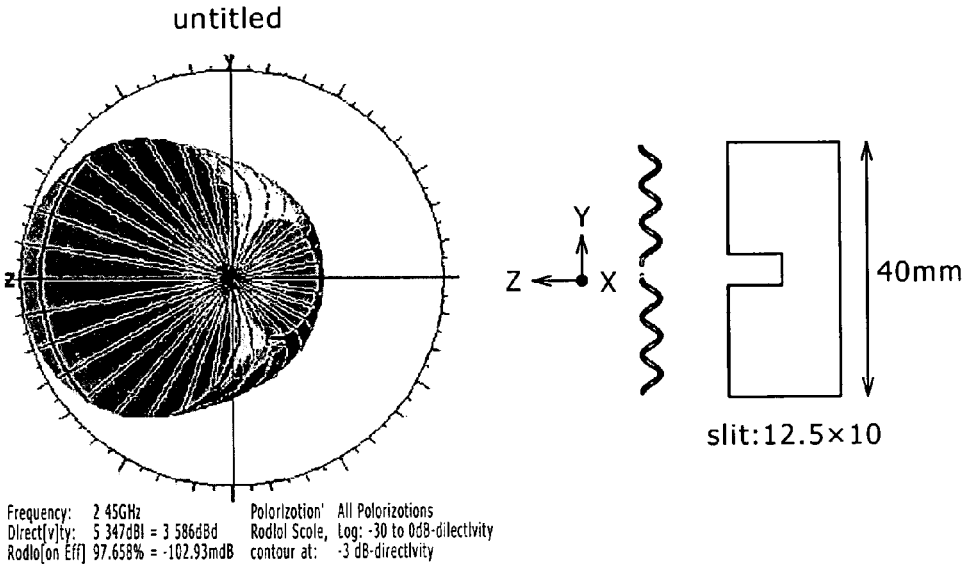
FIG. 3 is a graph showing directivity characteristics of an antenna device #2 listed in Table 1.
Figure 4:
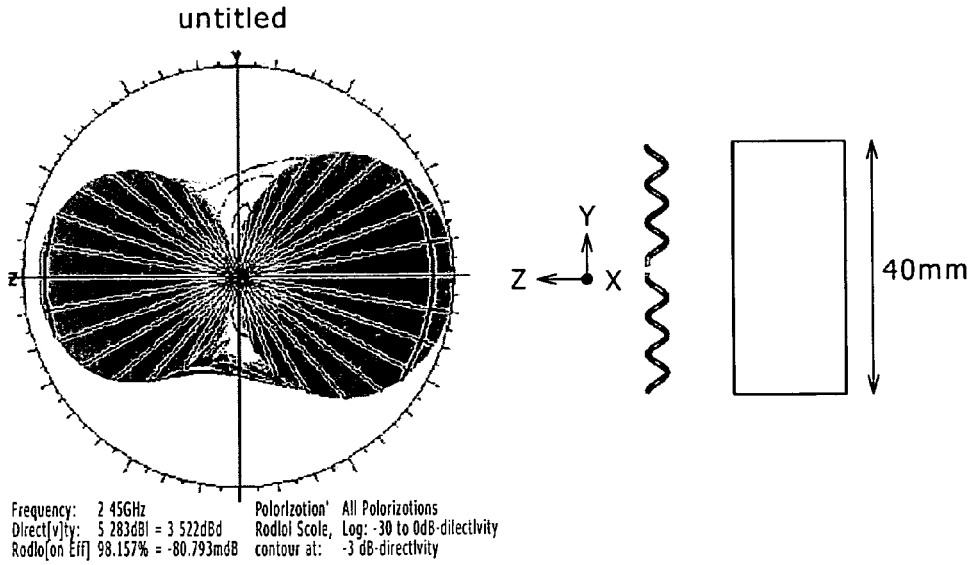
FIG. 4 is a graph showing directivity characteristics of an antenna device #3 listed in Table 1.
Figure 5:
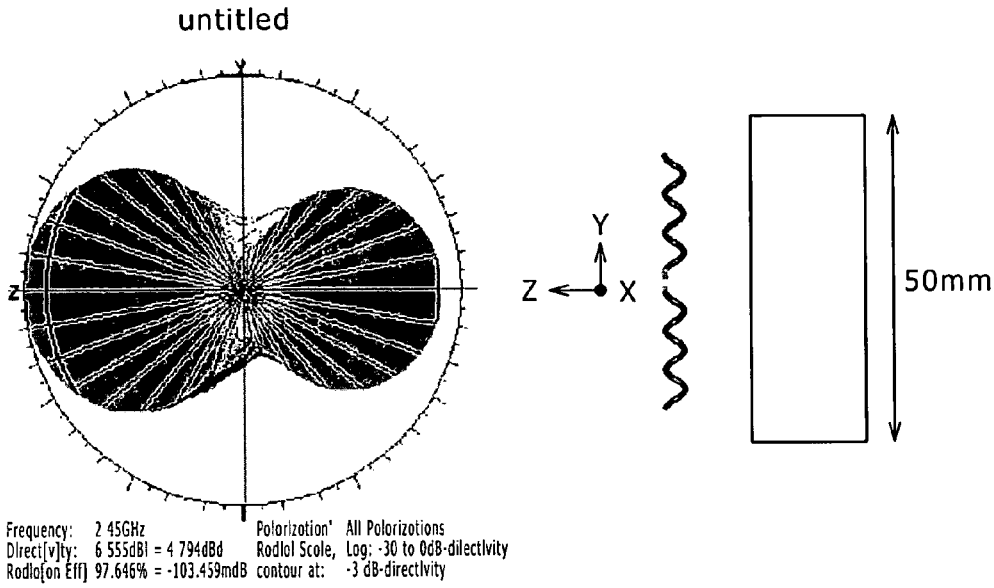
FIG. 5 is a graph showing directivity characteristics of an antenna device #4 listed in Table 1.
Figure 6:
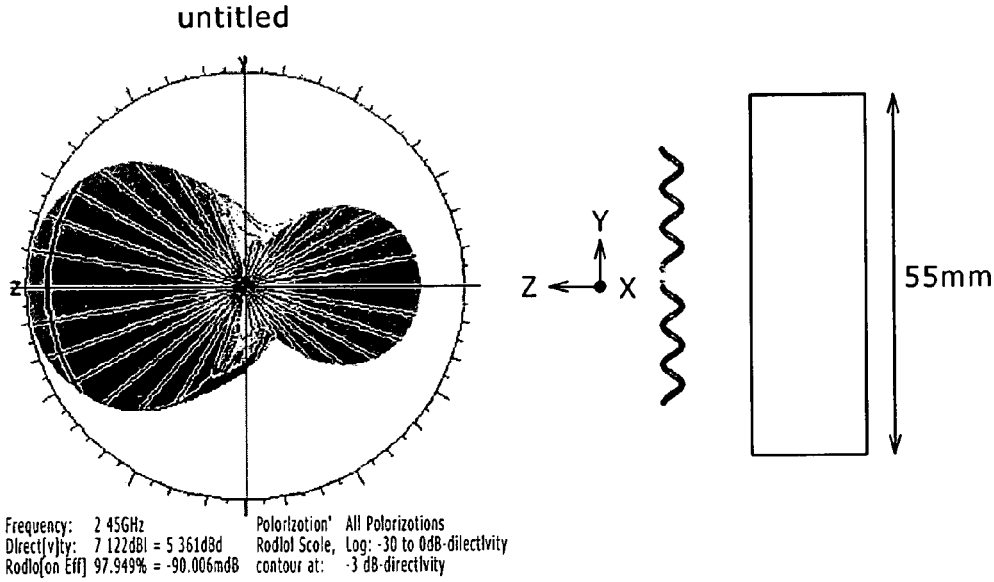
FIG. 6 is a graph showing directivity characteristics of an antenna device #5 listed in Table 1.
Figure 7:
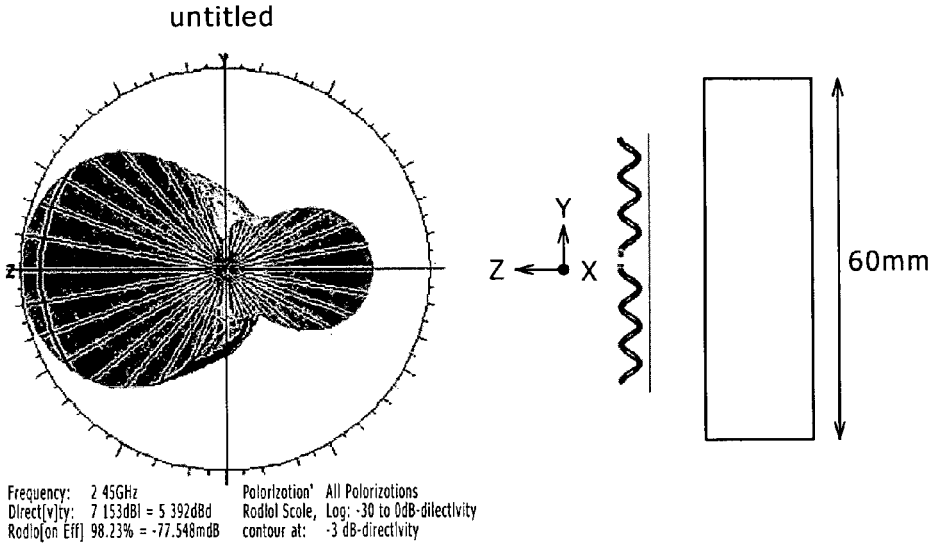
FIG. 7 is a graph showing directivity characteristics of an antenna device #6 listed in Table 1.
Figure 8:
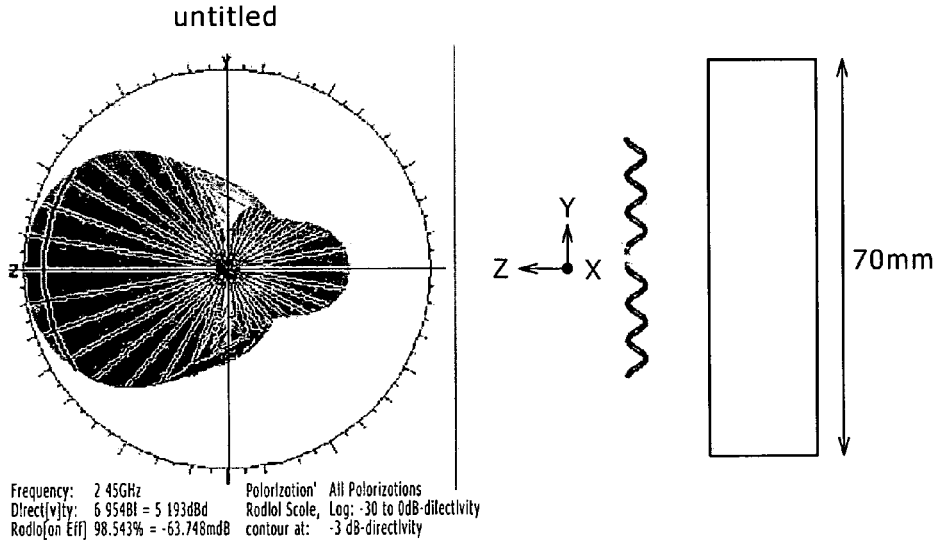
FIG. 8 is a graph showing directivity characteristics of an antenna device #7 listed in Table 1.

FIGS. 1A through 1C show an antenna device according to an embodiment of the present invention. FIGS. 1A and 1B are side elevational and plan views, respectively, of the antenna device, and FIG. 1C is a perspective view of the antenna device. The antenna device is an end-fire array antenna including a radiator and a reflector. The radiator includes a helical dipole antenna, and the reflector includes a corner reflector in the form of a conductor plate bent through a predetermined angle ψ (=90 degrees) along a ridge.

The helical dipole antenna is spaced from the corner of the corner reflector by a quarter of the used wavelength λ. The helical dipole antenna is used for linear polarization, and is positioned such that the corner of the corner reflector is present on the main plane of polarization of the helical dipole antenna.

The corner reflector has two sides extending parallel to the main plane of polarization and having respective slits defined therein for increasing the equivalent line length of the corner reflector in the direction of the electric field, i.e., for reducing the wavelength. Therefore, even if the dimension of the corner reflector in the direction of the electric field is reduced to one half of the used wavelength λ, the antenna device can have a front-to-rear ratio equal to the front-to-rear ratio of an antenna device having a corresponding dimension of λ/2 or more. Stated otherwise, if the antenna device employs a corner reflector having the same size as an antenna device having a corresponding dimension of λ/2 or more, then the antenna device can have a greater front-to-rear ratio.

In view of the fact that the current distribution of the reflector is high substantially centrally on the sides in the direction of the electric field, it is efficient to position the slits substantially centrally in the respective sides of the corner reflector which extend parallel to the main plane of polarization. For uniformizing the directivity of the antenna device laterally, the slits defined in the respective sides should preferably be symmetrical with respect to the main plane of polarization.

Table 1 shown below illustrates simulated antenna characteristics obtained from different antenna devices #1 through #7 which have the antenna device configuration shown in FIGS. 1A through 1C and in which the corner angle of the corner reflector is of 90 degrees and the distance between the dipole antenna and the corner is of 30 mm, with different lengths L and widths W of the slits and different dimensions (reflector lengths) of the corner reflectors in the electric field direction, on the assumption that the used frequency band is of 2.45 GHz. FIGS. 2 through 8 show respective directivity characteristics of the antenna devices #1 through #7 listed in Table 1.

TABLE 1

| No. | Reflector length (mm) | Wavelength at εr = 1 (λ) | Slit L × W | Peak Gain (dBi) | Efficiency (%) | Front-to-rear ratio | Half-value width |
|---|---|---|---|---|---|---|---|
| #1 | 40.0 | 0.33 | 12.5 × 5 | 6.67 | 96.7 | 5.5 | 70° |
| #2 | 40.0 | 0.33 | 15 × 10 | 5.35 | 97.7 | 16.0 | 83° |
| #3 | 40.0 | 0.33 | None | 5.28 | 98.2 | −2.0 | — |
| #4 | 50.0 | 0.41 | None | 6.56 | 97.6 | 2.7 | 64° |
| #5 | 55.0 | 0.45 | None | 7.12 | 97.9 | 5.9 | 67° |
| #6 | 60.0 | 0.49 | None | 7.15 | 98.2 | 8.4 | 68° |
| #7 | 70.0 | 0.57 | None | 6.95 | 98.5 | 12.0 | 69° |

As can be seen from Table 1 and FIGS. 2 through 8, with the helical dipole antenna being used as the radiator, it can be confirmed that a good front-to-rear ratio is obtained by a wavelength reducing effect to increase the line length in the direction of the electric field by providing the slits. For example, the antenna device #1 which has slits of a size 12.5 mm×5 mm defined in a corner reflector having a reflector length of 40.0 mm provides a front-to-rear ratio that is substantially the same as the front-to-rear ratio of the antenna device #5 which has a slit-free corner reflector having a reflector length of 55.0 mm. The antenna device #2 which has slits of a size 12.5 mm×10 mm defined in a corner reflector having a reflector length of 40.0 mm provides a front-to-rear ratio that is better than the front-to-rear ratio of the antenna device #7 which has a slit-free corner reflector having a reflector length of 70.0 mm. The antenna device #3 which has a slit-free corner reflector having a reflector length of 40.0 mm provides a poor front-to-rear ratio because the reflector acts as a waveguide.

If a dipole antenna is used as the radiator, then the peak gain is not increased by the slits.

Figure 9A:
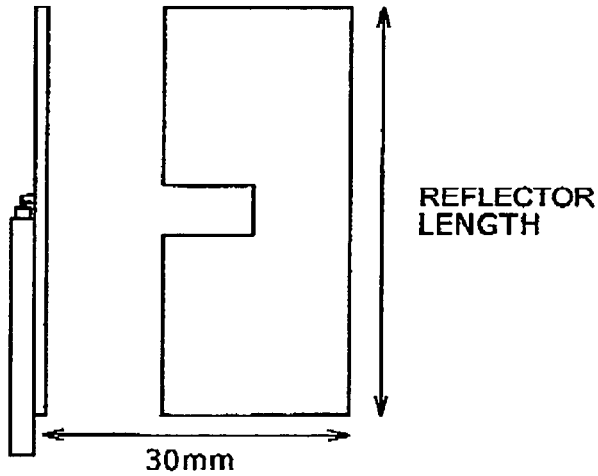
FIG. 9A is a side elevational view of an antenna device according to another embodiment of the present invention.
Figure 9B:
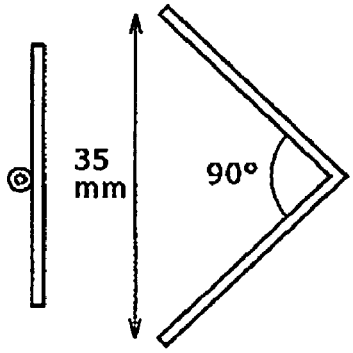
FIG. 9B is a plan view of the antenna device according to the other embodiment of the present invention.
Figure 9C:
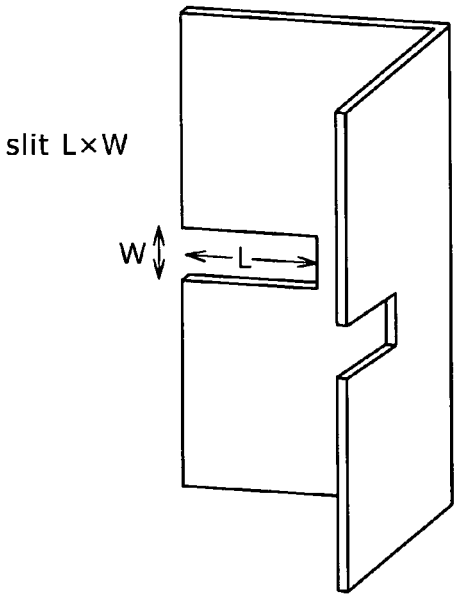
FIG. 9C is a perspective view of the antenna device according to the other embodiment of the present invention.
Figure 10:
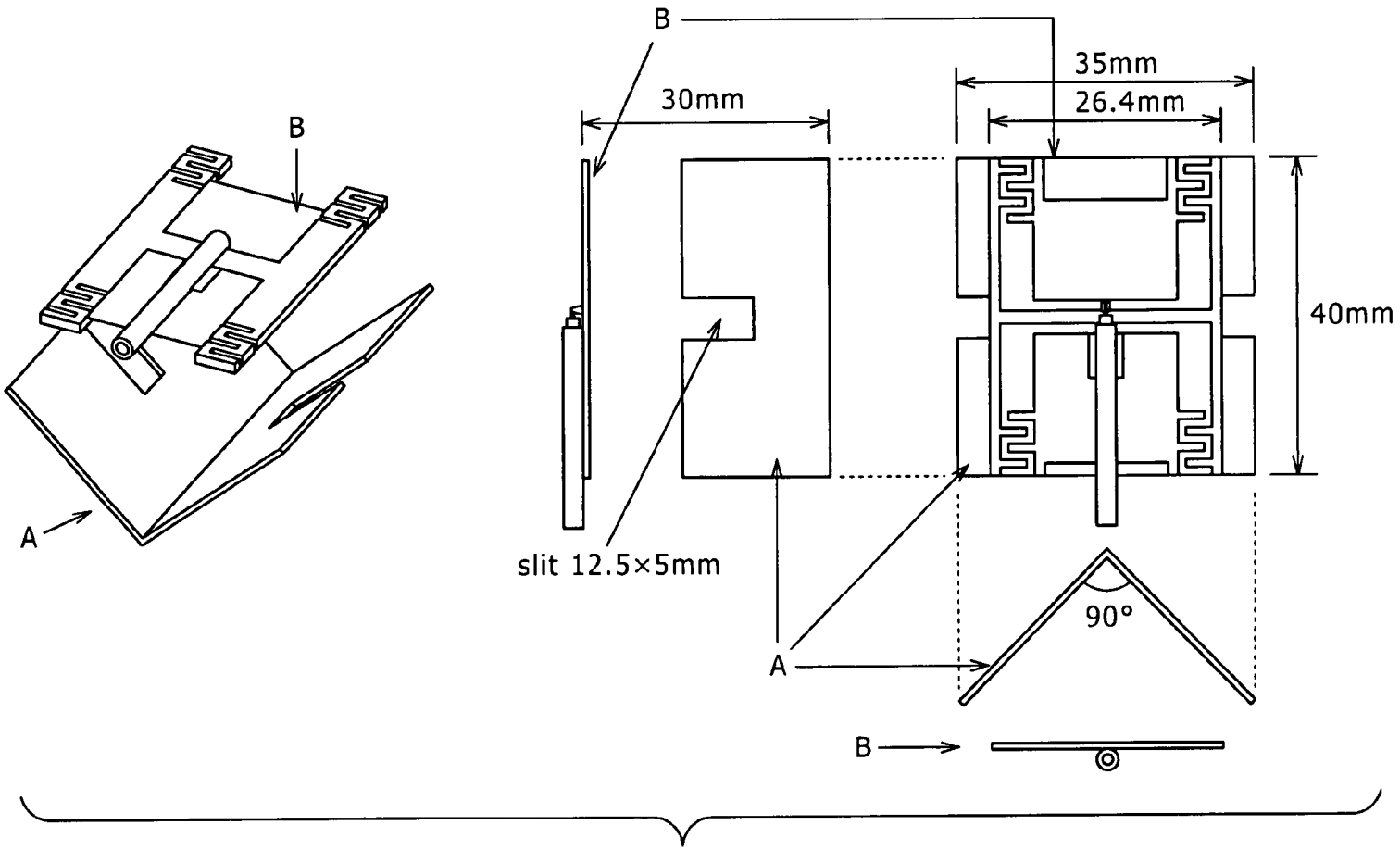
FIG. 10 is a view showing a stack antenna used in the antenna device shown in FIGS. 9A through 9C.

FIGS. 9A through 9C show an antenna device according to another embodiment of the present invention. FIGS. 9A and 9B are side elevational and plan views, respectively, of the antenna device, and FIG. 9C is a perspective view of the antenna device. The antenna device shown in FIGS. 9A through 9C is an end-fire array antenna including a radiator and a reflector. The antenna device shown in FIGS. 9A through 9C is different from the antenna device shown in FIGS. 1A through 1C in that the radiator includes a stack antenna including a stack of antenna patterns disposed on a flexible printed board. The stack antenna is used for linear polarization, and has better directivity than the dipole antenna.

The reflector includes a corner reflector in the form of a conductor plate bent through a predetermined angle ψ (=90 degrees) along a ridge. The stack antenna is spaced from the corner of the corner reflector by a quarter of the used wavelength λ and has its corner present on the main plane of polarization thereof.

The corner reflector has two sides extending parallel to the main plane of polarization and having respective linear slits defined therein symmetrically with respect to the main plane of polarization. The slits are effective in equivalently increasing the line length of the corner reflector in the direction of the electric field, i.e., effective in reducing the wavelength. Even if the dimension of the corner reflector in the direction of the electric field is reduced to one half of the used wavelength λ, the antenna device can have a front-to-rear ratio equal to the front-to-rear ratio of an antenna device having a corresponding dimension of λ/2 or more. Stated otherwise, if the antenna device employs a corner reflector having the same size as an antenna device having a corresponding dimension of λ/2 or more, then the antenna device can have a greater front-to-rear ratio.

Figure 11:
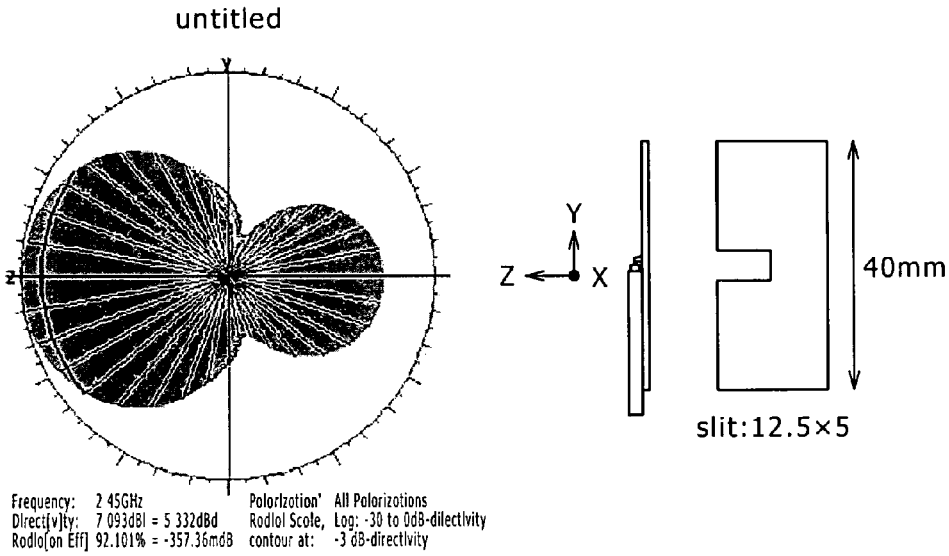
FIG. 11 is a graph showing directivity characteristics of an antenna device #8 listed in Table 2.
Figure 12:
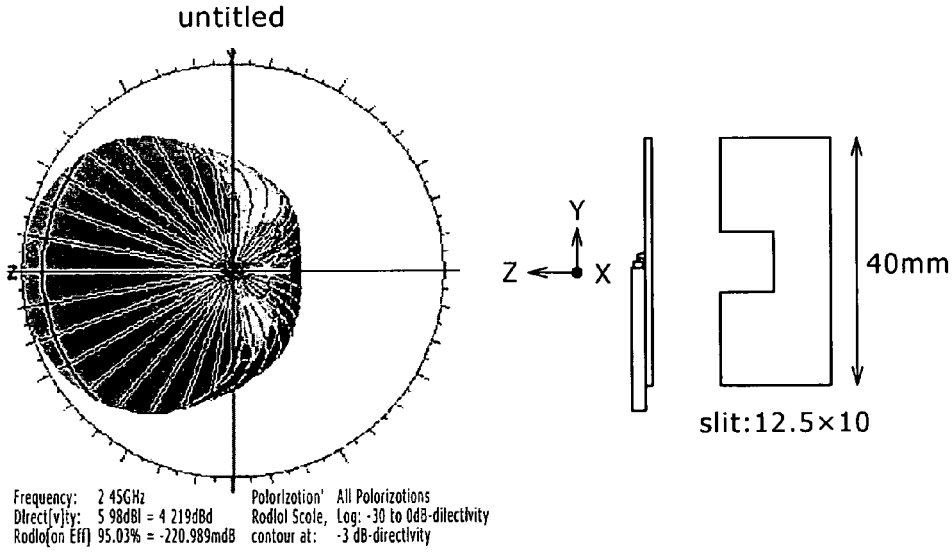
FIG. 12 is a graph showing directivity characteristics of an antenna device #9 listed in Table 2.

Table 2 shown below illustrates simulated antenna characteristics obtained from different antenna devices #8, #9 which have the antenna device configuration shown in FIGS. 9A through 9C and in which the corner angle of the corner reflector is of 90 degrees and the distance between the dipole antenna and the corner is of 30 mm, with different lengths L and widths W of the slits, on the assumption that the used frequency band is of 2.45 GHz. FIGS. 11 and 12 show respective directivity characteristics of the antenna devices #8, #9 listed in Table 2.

TABLE 2

| No. | Reflector length (mm) | Wavelength at εr = 1 (λ) | Slit L × W | Peak Gain (dBi) | Efficiency (%) | Front-to-rear ratio | Half-value width |
|---|---|---|---|---|---|---|---|
| #8 | 40.0 | 0.33 | 12.5 × 5 | 7.09 | 92.1 | 7.3 | 70° |
| #9 | 40.0 | 0.33 | 15 × 10 | 5.98 | 95.0 | 17.0 | 74° |

As can be seen from Table 2 and FIGS. 11 and 12, with the stack antenna being used as the radiator, it can be confirmed that a good front-to-rear ratio is obtained by a wavelength reducing effect to increase the line length in the direction of the electric field by providing the slits. For example, the antenna device #8 which has slits of a size 12.5 mm×5 mm defined in a corner reflector having a reflector length of 40.0 mm provides a front-to-rear ratio that is substantially the same as the front-to-rear ratio of the antenna device #5 which has a slit-free corner reflector having a reflector length of 55.0 mm. The antenna device #9 which has slits of a size 12.5 mm×10 mm defined in a corner reflector having a reflector length of 40.0 mm provides a front-to-rear ratio that is much better than the front-to-rear ratio of the antenna device #7 which has a slit-free corner reflector having a reflector length of 70.0 mm.

Since the stack antenna has higher directivity than the dipole antenna, the peak gain is increased by providing the slits in the corner reflector.

In the embodiments shown in FIGS. 1A through 1C and 9A through 9C, the slits are linear in shape. However, the slits may be straight or curved in shape. Furthermore, slits of complex shapes such as fractal shapes are effective in reducing the wavelength.

In the embodiments shown in FIGS. 1A through 1C and 9A through 9C, the antenna device has a linearly polarized radiator. However, the present invention is also applicable to a circularly polarized antenna device. The linearly polarized antenna device has slits disposed symmetrically with respect to the main plane of polarization. Since the main plane of polarization rotates in the direction of polarization, the circularly polarized antenna device may have two or more pairs of slits that are in point symmetry with respect to the direction of polarization for a better front-to-rear ratio.

Figure 13A:
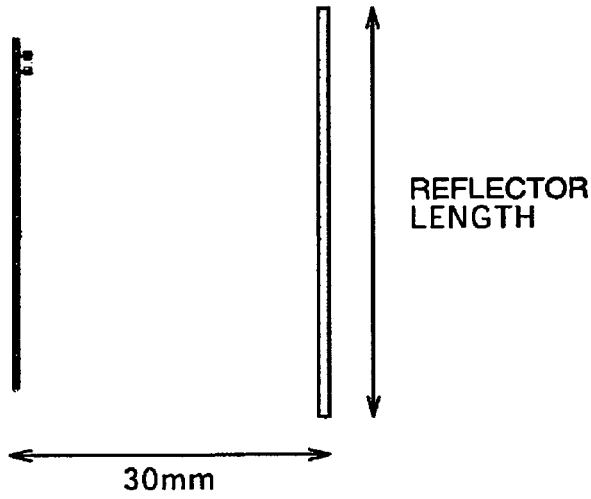
FIG. 13A is a side elevational view of an antenna device for circular polarization.
Figure 13B:
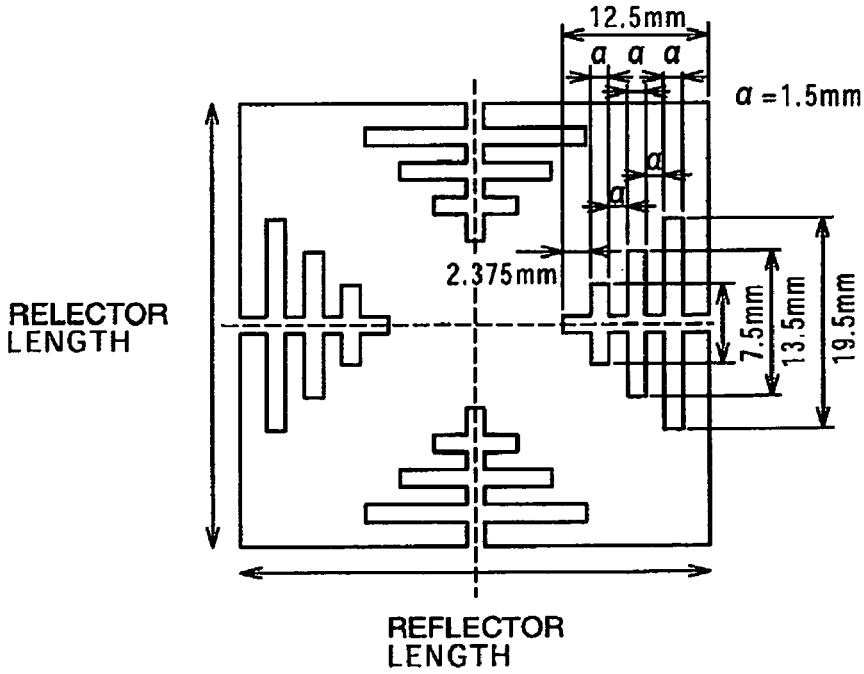
FIG. 13B is a plan view of the antenna device for circular polarization.
Figure 13C:
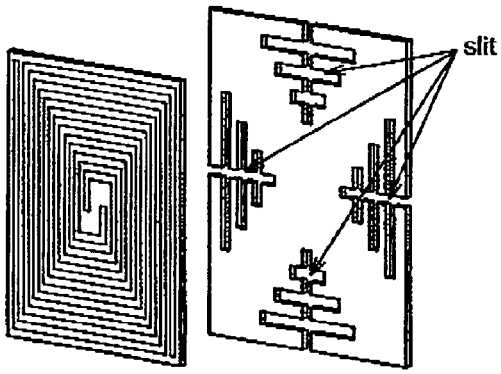
FIG. 13C is a perspective view of the antenna device for circular polarization.

FIGS. 13A through 13C show an antenna device for circular polarization. FIGS. 13A and 13B are side elevational and plan views, respectively, of the antenna device, and FIG. 13C is a perspective view of the antenna device. In FIGS. 13A through 13C, the antenna device includes a radiator including an Archimedean spiral antenna. The Archimedean spiral antenna has antenna elements extending spirally and having turns spaced at substantially equal intervals.

The antenna device also includes a reflector in the form of a square conductor plate. The Archimedean spiral antenna is spaced a quarter of the used wavelength λ from the reflector. The square reflector is located such that its center (the point of intersection of diagonal lines) present in the direction of polarization of the Archimedean spiral antenna.

The reflector is thus disposed in point symmetry in the direction of polarization, so that the two pairs of sides thereof are each in point symmetry in the direction of polarization. As shown in FIGS. 13B and 13C, the reflector has slits in fractal patterns defined substantially centrally in the respective four sides thereof, the slits being in point symmetry in the direction of polarization. The reflector thus configured is effective in increasing the line length in the direction of the electric field, i.e., in reducing the wavelength. Even if the dimension of the reflector in the direction of the electric field is equal to or smaller than one half of the used wavelength λ, the antenna device can have a front-to-rear ratio equal to the front-to-rear ratio of an antenna device having a corresponding dimension of λ/2 or more. Stated otherwise, if the antenna device employs a corner reflector having the same size as an antenna device having a corresponding dimension of λ/2 or more, then the antenna device can have a greater front-to-rear ratio.

Figure 14A:
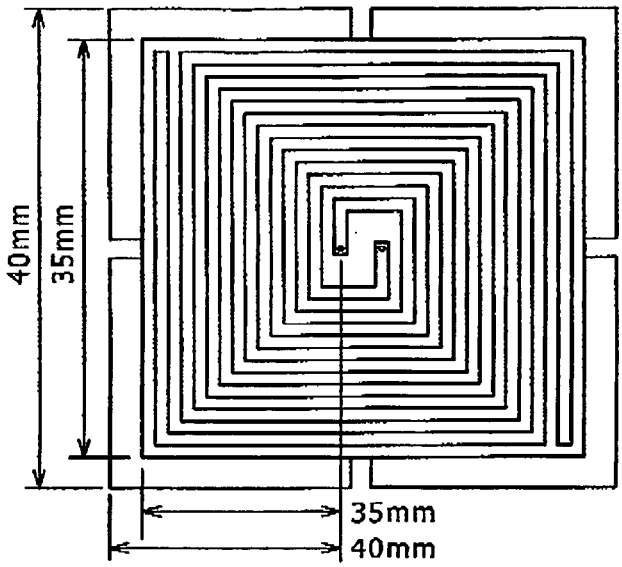
FIG. 14A is a view of an Archimedean spiral antenna.
Figure 14B:
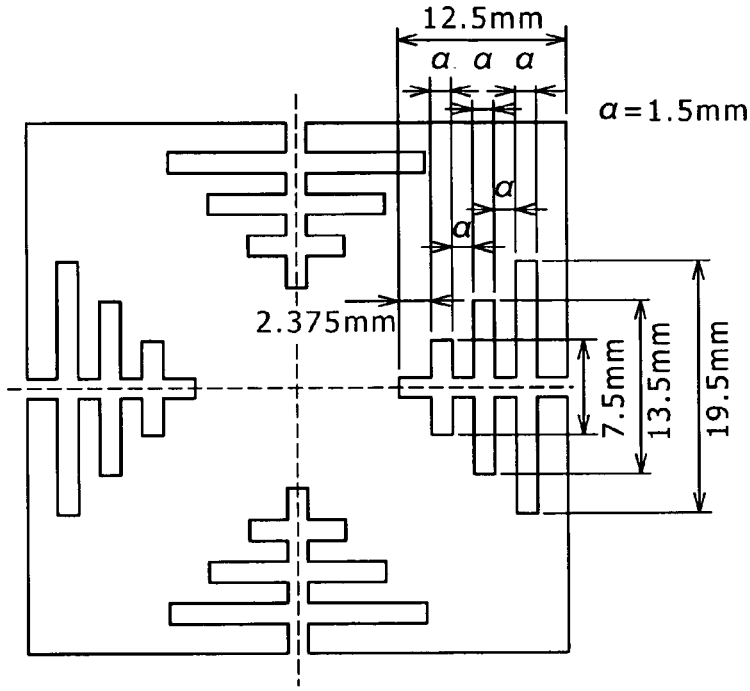
FIG. 14B is a view of a reflector with fractal slit patterns.
Figure 15:
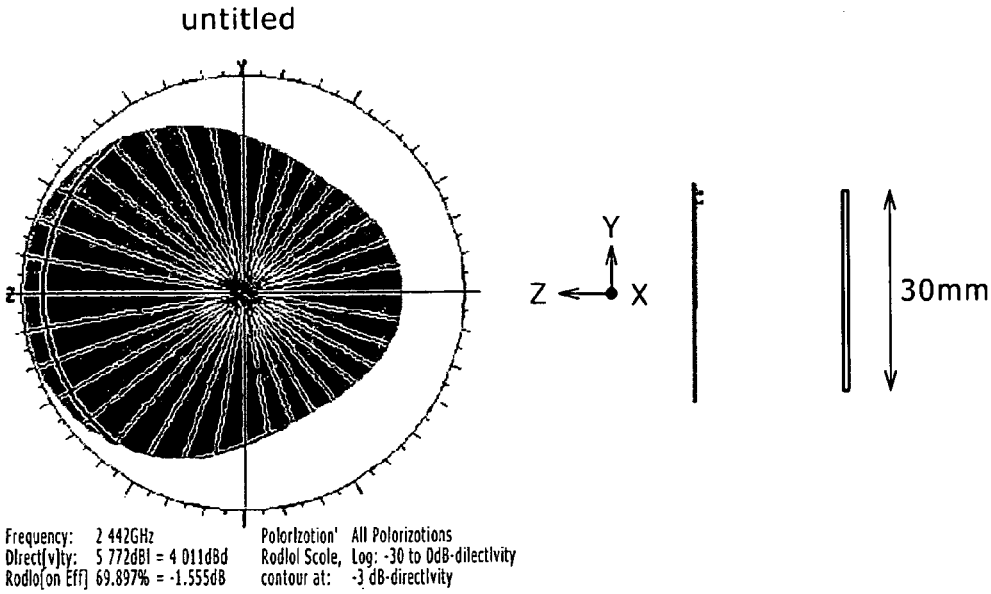
FIG. 15 is a graph showing directivity characteristics of an antenna device #10 listed in Table 3.
Figure 16:
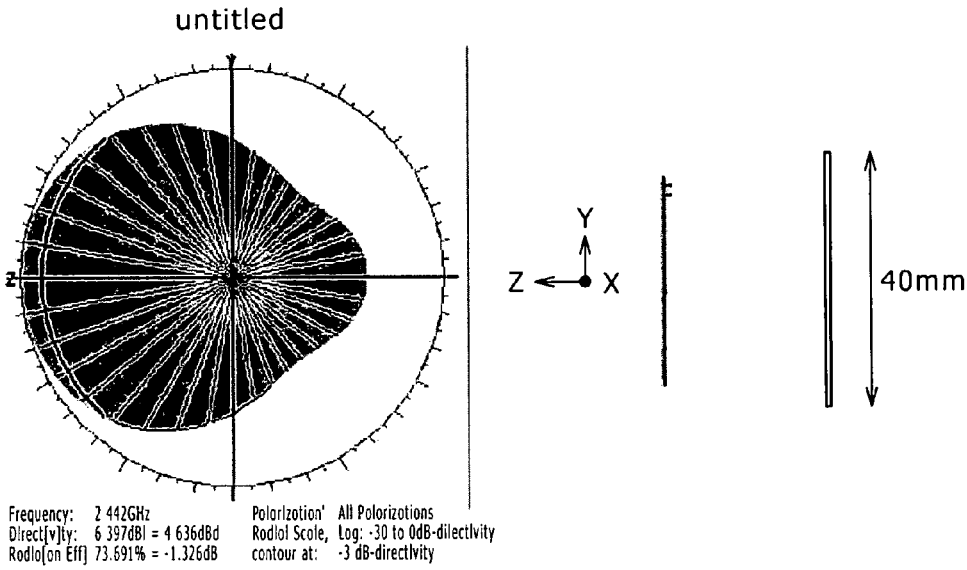
FIG. 16 is a graph showing directivity characteristics of an antenna device #11 listed in Table 3.
Figure 17:
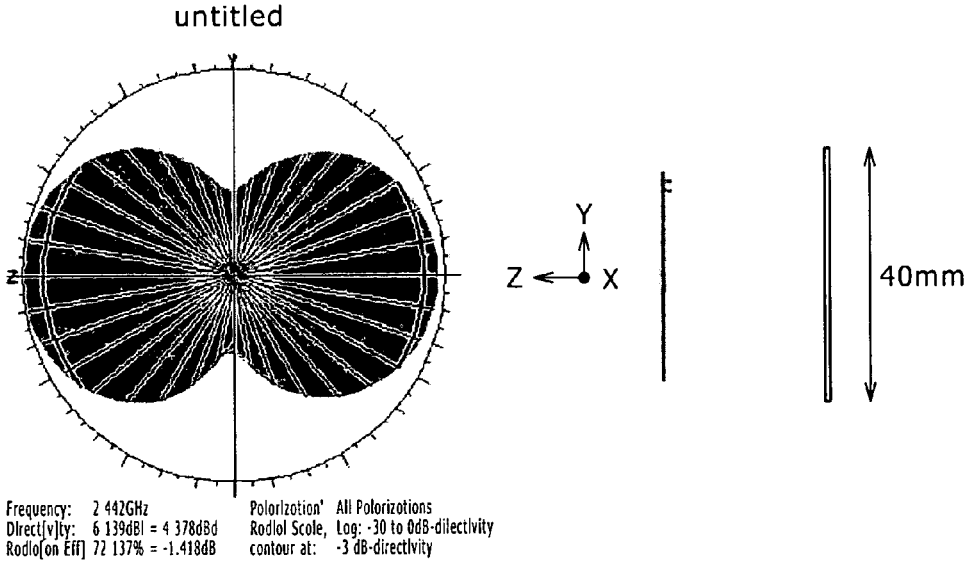
FIG. 17 is a graph showing directivity characteristics of an antenna device #12 listed in Table 3.
Figure 18:
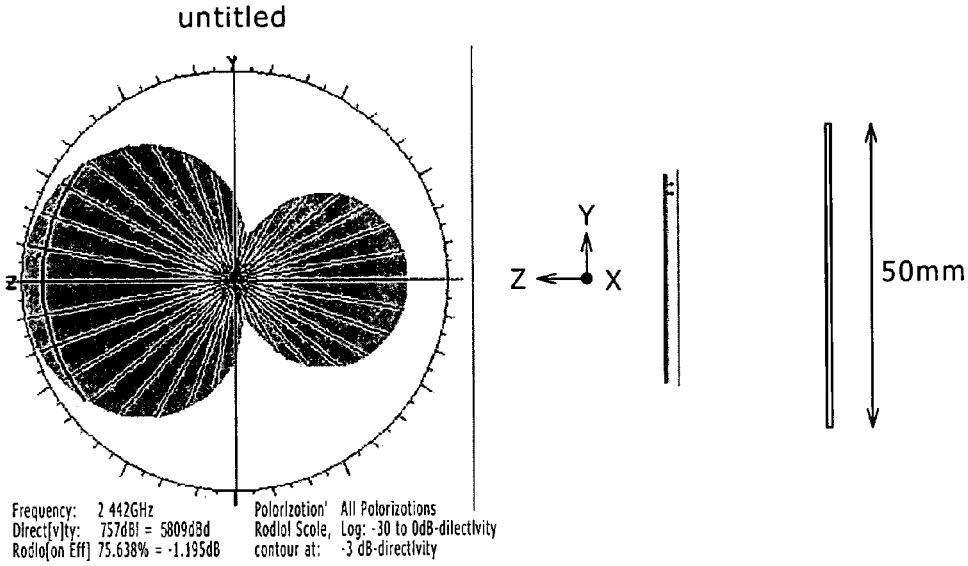
FIG. 18 is a graph showing directivity characteristics of an antenna device #13 listed in Table 3.
Figure 19:
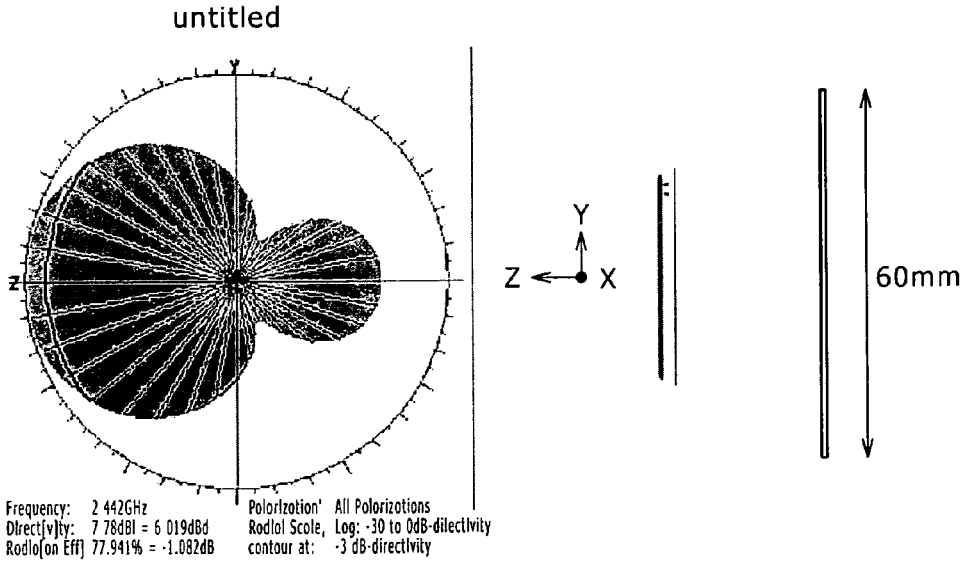
FIG. 19 is a graph showing directivity characteristics of an antenna device #14 listed in Table 3.

Table 3 shown below illustrates simulated antenna characteristics obtained from different antenna devices #10 through #14 which have the antenna device configuration shown in FIGS. 13A through 13C and in which the distance between the radiator and the reflector is of 30 mm, with different reflector dimensions and different dimensions (reflector lengths) without slits, on the assumption that the used frequency band is of 2.45 GHz. FIG. 14A shows the Archimedean spiral antenna that is used, and FIG. 14B shows the reflector with the slits in the fractal patterns. FIGS. 15 through 19 show respective directivity characteristics of the antenna devices #10 through #14 listed in Table 3.

TABLE 3

| No. | Reflector length (mm) | Wavelength at εr = 1 (λ) | Slit | Peak Gain (dBi) | Efficiency (%) | Front-to-rear ratio | Half-value width |
|---|---|---|---|---|---|---|---|
| #10 | 30.0 | 0.25 | Fractal | 5.77 | 69.9 | 8.3 | 112° |
| #11 | 40.0 | 0.33 | Fractal | 6.40 | 73.7 | 10.9 | 95° |
| #12 | 40.0 | 0.33 | None | 6.14 | 72.1 | 1.0 | — |
| #13 | 50.0 | 0.41 | None | 7.57 | 75.9 | 5.7 | 78° |
| #14 | 60.0 | 0.49 | None | 7.78 | 77.9 | 9.3 | 79° |

As can be seen from Table 3 and FIGS. 15 through 19, with the Archimedean spiral antenna being used as the radiator, it can be confirmed that a good front-to-rear ratio is obtained by a wavelength reducing effect to increase the line length in the direction of the electric field by providing the fractal slit patterns in the four sides of the reflector in point symmetry in the direction of polarization. For example, the antenna device #10 which has fractal slit patterns defined in the respective sides of a reflector having a reflector length of 30.0 mm provides a front-to-rear ratio that is higher than the front-to-rear ratio of the antenna device #13 which has a slit-free reflector having a reflector length of 50.0 mm. The antenna device #11 which has fractal slit patterns defined in the respective sides of a reflector having a reflector length of 40.0 mm provides a front-to-rear ratio that is much better than the front-to-rear ratio of the antenna device #14 which has a slit-free reflector having a reflector length of 60.0 mm.

Figure 20:
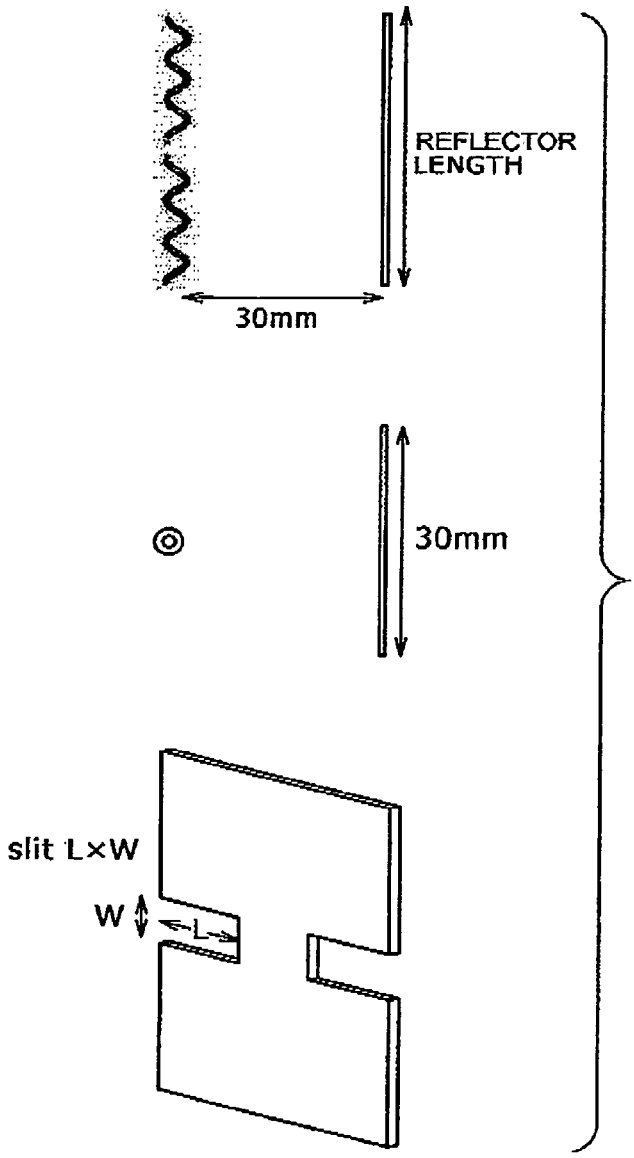
FIG. 20 is a view of an antenna device including a dipole antenna and a flat reflector spaced from the dipole antenna in its main direction of polarization.

The effect that the size L×W of the slits of the reflector has on the antenna characteristics will be examined below. Tables 4 and 5 shown below illustrate simulated antenna characteristics obtained from different antenna devices #15 through #27 which have different sizes of slits defined centrally in two sides parallel to the main plane of polarization in an antenna device configuration shown in FIG. 20 which includes a dipole antenna and a flat reflector spaced from the dipole antenna by λ/4 (30 mm) in the main direction of polarization, on the assumption that the used frequency band is of 2.45 GHz. In the antenna device group shown in Table 4, the reflector has a dimension of 40 mm in the direction of the electric field, i.e. a reflector length of 40 mm. In the antenna device group shown in Table 5, the reflector has a reflector length of 30 mm. In each of Tables 4 and 5, the reflector has a width of 35 mm.

TABLE 4

| No. | Reflector length (mm) | Wavelength at εr = 1 (λ) | Slit L × W | Peak Gain (dBi) | Efficiency (%) | Front-to-rear ratio | Half-value width |
|---|---|---|---|---|---|---|---|
| #15 | 40.0 | 0.33 | None | 5.28 | 98.2 | −2.0 | — |
| #16 | 40.0 | 0.33 | 9.5 × 1 | 5.21 | 98.9 | 2.0 | — |
| #17 | 40.0 | 0.33 | 12.5 × 5 | 6.26 | 98.5 | 6.1 | 100° |
| #18 | 40.0 | 0.33 | 15 × 10 | 4.25 | 99.1 | 7.8 | 84° |
| #19 | 40.0 | 0.33 | 17 × 6 | 3.59 | 98.9 | 5.5 | 84° |
| #20 | 40.0 | 0.33 | 17 × 16 | 2.90 | 99.3 | 3.1 | 85° |
| #21 | 40.0 | 0.33 | 17 × 23 | 2.86 | 99.3 | 2.9 | — |

TABLE 5

| No. | Reflector length (mm) | Wavelength at εr = 1 (λ) | Slit L × W | Peak Gain (dBi) | Efficiency (%) | Front-to-rear ratio | Half-value width |
|---|---|---|---|---|---|---|---|
| #22 | 30.0 | 0.25 | None | 3.58 | 99.3 | −0.8 | — |
| #23 | 30.0 | 0.25 | 9.5 × 1 | 3.68 | 99.2 | −0.8 | — |
| #24 | 30.0 | 0.25 | 12.5 × 5 | 4.35 | 98.8 | 0.7 | — |

TABLE 5-continued

| No. | Reflector length (mm) | Wavelength at εr = 1 (λ) | Slit L × W | Peak Gain (dBi) | Efficiency (%) | Front-to-rear ratio | Half-value width |
|---|---|---|---|---|---|---|---|
| #25 | 30.0 | 0.25 | 15 × 10 | 5.13 | 98.5 | 8.1 | 80° |
| #26 | 30.0 | 0.25 | 17 × 16 | 2.94 | 99.2 | 3.2 | 86° |
| #27 | 30.0 | 0.25 | 17 × 23 | 2.94 | 99.3 | 3.1 | 87° |

In the antenna device group with the reflector length of 40 mm, the antenna device #17 having a slit size 12.5 mm×5 mm exhibits a maximum antenna gain (peak gain), and the antenna device #18 having a slit size 15 mm×10 mm exhibits a maximum front-to-rear ratio. As the slit length L and the slit width W become greater, the antenna gain and the front-to-rear ratio become smaller. The reflector originally operates as ground and produces an image antenna behind the ground. The reduction in the antenna gain and the front-to-rear ratio is considered to be caused by the fact that as the slit is greater, the reflector tends to lose its function to act as the ground. Stated otherwise, the reflector length and the slit size need to be determined depending on the used wavelength λ.

In the antenna device group with the reflector length of 30 mm, the antenna device #25 having a slit size 15 mm×10 mm exhibits both a maximum antenna gain (peak gain) and a maximum front-to-rear ratio. As the slit length L and the slit width W become greater, the antenna gain and the front-to-rear ratio become smaller.

For reference, Table 6 shown below illustrates simulated antenna characteristics obtained from different antenna devices #28 through #32 which have slit-free reflectors and different reflector lengths in an antenna device configuration which includes a dipole antenna and a flat reflector spaced from the dipole antenna by λ/4 (30 mm) in the main direction of polarization, on the assumption that the used frequency band is of 2.45 GHz. The reflector has a width of 35 mm. Since no wavelength reducing effect is produced without slits, a sufficient front-to-rear ratio cannot be obtained unless the reflector length is λ/2 or greater. As the reflector length becomes greater, the antenna gain (peak gain) becomes higher. The increase in the antenna gain is considered to be caused by the fact that as the size of the reflector is greater, the reflector tends to intensify its function to act as the ground.

TABLE 6

| No. | Reflector length (mm) | Wavelength at εr = 1 (λ) | Slit L × W | Peak Gain (dBi) | Efficiency (%) | Front-to-rear ratio | Half-value width |
|---|---|---|---|---|---|---|---|
| #28 | 30.0 | 0.25 | None | 3.58 | 99.3 | −0.8 | — |
| #29 | 40.0 | 0.33 | None | 5.28 | 98.2 | −2.0 | — |
| #30 | 50.0 | 0.41 | None | 6.36 | 99.1 | 4.2 | 70° |
| #31 | 60.0 | 0.49 | None | 6.43 | 99.3 | 8.1 | 72° |
| #32 | 70.0 | 0.57 | None | 6.21 | 99.4 | 10.2 | 72° |

A wireless communication unit incorporating an antenna device according to the present invention therein will be described below.

The Bluetooth communications are known as standards for providing wireless connection interfaces applicable to various industries. One application of the Bluetooth communications is data communications from a wireless microphone as an acoustic data source to a receiver unit as a sink for receiving and transferring acoustic data to a video recorder. The wireless microphone allows the video subject to move in a range that is not limited by the microphone cord.

The reception antenna of the receiver unit is required to have sharp directivity toward the wireless microphone. Therefore, an antenna device having a planar reflector, such as a corner reflector antenna having a high front-to-rear ratio, is desirable for use as the reception antenna of the receiver unit. If a receiver unit incorporates an antenna device therein, then since a radiator is disposed in front of a reflector, it is desirable to provide a space for accommodating other circuit components behind the reflector. The antenna device is required to have a high front-to-rear ratio in order to avoid the generation of an interference wave against the circuit components.

Figure 21:
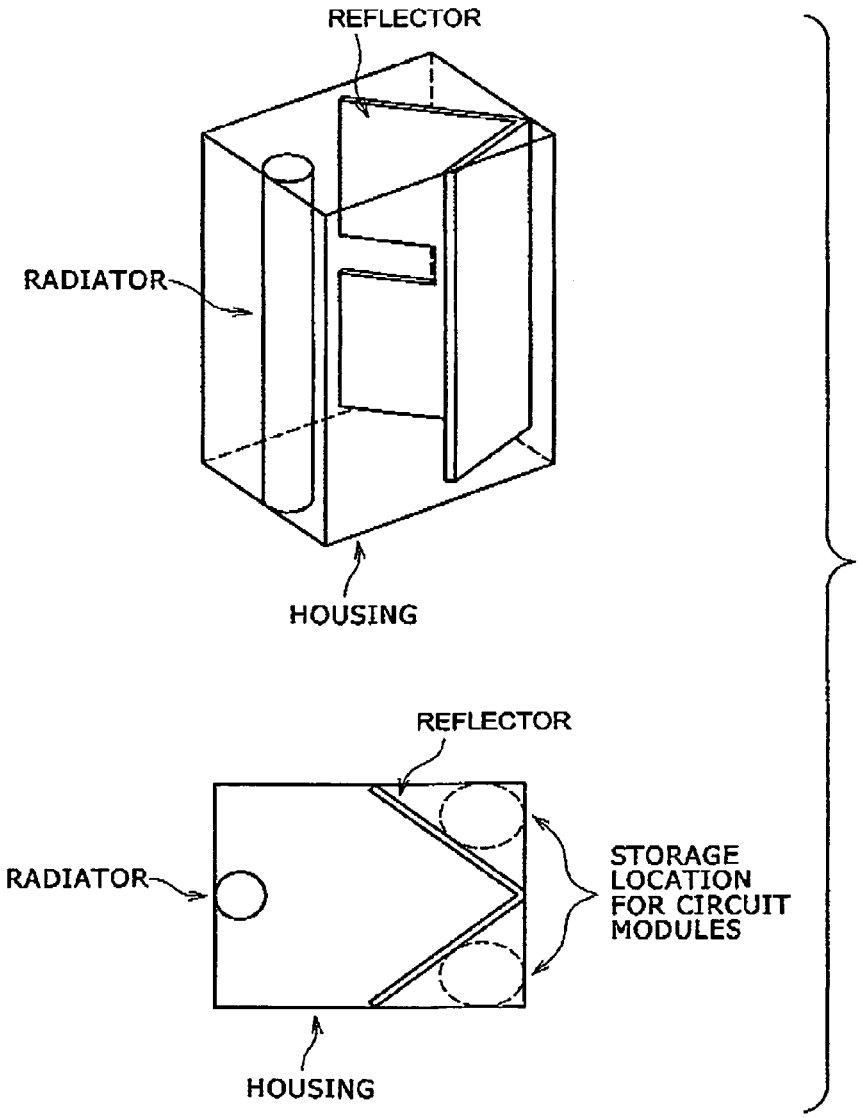
FIG. 21 is a view showing internal structural details of a receiver unit incorporating a reception antenna device therein.

FIG. 21 shows internal structural details of a receiver unit incorporating a reception antenna device therein.

The reception antenna device is an end-fire array antenna including a radiator and a reflector. The reflector includes a corner reflector in the form of a conductor plate bent through a predetermined angle ψ of 90 degrees, for example, along a ridge. In the illustrated reception antenna device, the radiator includes a helical dipole antenna. However, from the standpoints of directivity and peak gain, the radiator should preferably be a stack antenna.

The helical dipole antenna as the radiator is spaced from the corner of the corner reflector by a quarter of the used wavelength λ.

As already described above, the corner reflector has two sides extending parallel to the main plane of polarization and having respective slits defined therein for increasing the equivalent line length of the corner reflector in the direction of the electric field, i.e., for reducing the wavelength. Therefore, even if the dimension of the corner reflector in the direction of the electric field is reduced to one half of the used wavelength λ, the antenna device has a sufficient a front-to-rear ratio.

Behind the corner reflector, there is a space between the bent conductor plate of the corner reflector and the lateral corners of a unit housing. The space can be used as a storage location for accommodating the circuit modules of the receiver.

The wavelength reducing effect that is provided by the slits defined in the respective sides of the corner reflector which are parallel to the main plane of polarization allows the reception antenna device to have a high front-to-rear ratio for suppressing radio waves directed rearwardly of the corner reflector. Therefore, the reception antenna device is substantially free of the problem of an interference with the wireless circuit modules that are accommodated in the storage location.

The present invention has been described in detail above with reference to the specific embodiments. However, it is obvious that changes and modifications may be made in the embodiments by those skilled in the art without departing from the scope of the invention. The present invention has been disclosed by way of illustrative example only, and the description of the present specification should not be construed in a limited manner. The scope of the claims should be taken into account to determine the scope of the invention.

What is claimed is:

1. An antenna device comprising:

a radiator having a feeder; and first and second reflector elements spaced from said radiator;

wherein said first and second reflector elements are substantially symmetrical and being planar structures extending from a common intersection;

said first and second reflector elements having at least one slit defined in a side thereof that is located substantially in a central portion of the reflector element at which the slit is located, and wherein each slit is located at an outermost side edge, wherein the at least one slit is comprised of at least a pair of slits that are defined symmetrically.

2. The antenna device according to claim 1, wherein said slit is substantially centrally located.

3. The antenna device according to claim 1, wherein said slit has a fractal pattern.

4. The antenna device according to claim 1, wherein said reflector elements have a dimension of at most one half of the used wavelength λ.

5. The antenna device according to claim 1, wherein said radiator comprises a linearly polarized antenna.

6. The antenna device according to claim 1, wherein said radiator comprises a circularly polarized radiator.

7. An antenna reflector for reflecting an incoming radio wave toward a radiator, comprising:

first and second planar conductor plates;

said planar conductor plates having at least one slit defined in a side edge, and wherein each slit is located at an outermost side edge, wherein said radiator comprises a circularly polarized antenna, and said conductor plates have a pair of side edges which are symmetrical in shape with respect to at least two directions of polarization, and slits defined respectively in said side edges symmetrically with respect to said directions of polarization.

8. The antenna reflector according to claim 7, wherein said slit is in a side of at least one of said conductor plates.

9. The antenna reflector according to claim 7, wherein said slit is defined centrally in the side edge of one conductor.

10. The antenna reflector according to claim 7, wherein said slit has a fractal pattern.

11. The antenna reflector according to claim 7, wherein said planar conductor plates are symmetrical with respect to a direction of polarization and at least a pair of slits are located at opposed respective side edges symmetrically with respect to the direction of polarization.

12. The antenna reflector according to claim 7, wherein said first planar conductor plate has a dimension of at most one half of the used wavelength λ in the direction of an electric field.

13. The antenna reflector according to claim 7, wherein said radiator comprises a linearly polarized antenna, and said slit is defined in a side edge of at least one of said conductor plates which is parallel to a main direction of polarization of said radiator.

* * * * *